United States Patent [19]

Campbell et al.

[11] 3,985,662

[45] Oct. 12, 1976

[54] HIGH DROPPING POINT GREASES COMPRISING A LITHIUM SOAP OF AN EPOXY-SUBSTITUTED AND/OR AN ETHYLENICALLY UNSATURATED FATTY ACID

[75] Inventors: Ian D. Campbell, Sarnia; Terrance O. Brown, Corunna, both of Canada; Donald W. Murray, Mont-Saint-Aignan, France

[73] Assignee: Exxon Research and Engineering Company, Linden, N.J.

[22] Filed: Feb. 28, 1975

[21] Appl. No.: 554,210

[52] U.S. Cl. ..... 252/41

[51] Int. Cl.[2] ..... C10M 1/24; C10M 3/18; C10M 5/14; C10M 7/20

[58] Field of Search ..... 252/41

[56] References Cited

UNITED STATES PATENTS

| | | | |
|---|---|---|---|
| 2,898,296 | 8/1959 | Pattenden et al. | 252/41 |
| 2,951,808 | 9/1960 | Norton et al. | 252/41 |
| 3,000,823 | 9/1961 | Clarke et al. | 252/41 |
| 3,009,878 | 11/1961 | Eckert | 252/41 |
| 3,711,407 | 1/1973 | Plumstead | 252/41 |
| 3,791,973 | 2/1974 | Gilani et al. | 252/41 |

*Primary Examiner*—Delbert E. Gantz
*Assistant Examiner*—I. Vaughn
*Attorney, Agent, or Firm*—Wayne Hoover

[57] ABSTRACT

Grease compositions comprising (1) a lithium soap derived from a fatty acid containing an epoxy group and/or ethylenic unsaturation, and (2) a dilithium soap derived from a straight chain dicarboxylic acid. In a preferred embodiment, the grease composition will also comprise a lithium salt derived from a hydroxy-substituted carboxylic acid. Greases comprising lithium salts derived from an epoxy substituted fatty acid in combination with other lithium salts and derived from an ethylenically unsaturated fatty acid, a dicarboxylic acid and a hydroxy-substituted aromatic acid are particularly effective.

17 Claims, No Drawings

HIGH DROPPING POINT GREASES COMPRISING A LITHIUM SOAP OF AN EPOXY-SUBSTITUTED AND/OR AN ETHYLENICALLY UNSATURATED FATTY ACID

BACKGROUND OF THE INVENTION

This invention relates to an improved lubricating composition. More particularly, this invention relates to an improved grease composition.

It is, of course, well known, in the prior art, that various lithium soaps can advantageously be used in the preparation of lubricating greases from essentially any lubricating base oil stock, and that the greases thus prepared will, generally, exhibit good grease properties and/or characteristics. It is also well known that certain of these properties and/or characteristics, such as mechanical and/or shear stability, dropping point and oxidation resistance, will vary from grease to grease depending upon the particular lithium soap used therein. For example, greases prepared with a lithium soap derived from a hydroxy-substituted fatty acid such as 12-hydroxystearic acid will generally exhibit better mechanical and/or shear stability and these greases are, generally, obtained in greater yields than those prepared with other lithium soaps. None of the lithium soaps known to be useful in the prior art, when used separately, however, will yield a grease exhibiting the unique combinations of properties, such as a high dropping point, good mechanical and/or shear stability, high resistance to water and good oxidation stability, that are required for greases used in such severe applications as the lubrication of traction motor bearings and the lubrication of wheel bearings on cars with disc brakes, and none offer the long lubricating life generally desired in these applications.

As a result, considerable effort has heretofore been devoted to the preparation of greases comprising mixtures of various lithium salts in an effort to optimize grease properties for a particular application or applications. For the most part, however, this effort has centered around soap combinations comprising at least one lithium soap derived from a hydroxy-substituted fatty acid and particularly 12-hydroxystearic acid, primarily because of the known advantages associated with greases containing these particular soaps and, indeed, several grease compositions comprising one or more such lithium soaps and one or more other lithium soaps and exhibiting particularly desirable combinations of properties have heretofore been developed. Recently, however, the availability and costs of the hydroxy-substituted fatty acids have been subject to severe fluctuations, which have, on occasions, made it difficult to meet the demand for greases exhibiting the unique combination of properties characteristic of greases comprising such fatty acids and nearly impossible to do so on a competitive basis. The need then for a grease composition exhibiting substantially the same high dropping points, the excellent mechanical and shear stability, the high resistance to water, excellent oxidation stability and the long lubricating life which are characteristic of certain greases containing lithium soaps derived from hydroxy-substituted fatty acids, and which can be prepared from a more staple commodity and, generally sold at a lower cost, is then believed to be readily apparent.

SUMMARY OF THE INVENTION

It has now been surprisingly discovered that the foregoing and other disadvantages of the prior art can be avoided with the compositions of this invention and a grease composition exhibiting properties comparable to those of certain prior art compositions provided thereby. It is, therefore, an object of this invention to provide a grease composition. It is another object of this invention to provide a grease composition exhibiting a relatively high dropping point. It is still another object of this invention to provide a grease composition exhibiting a excellent mechanical and/or shear stability. It is yet another object of this invention to provide a grease composition exhibiting a high resistance to water and a good oxidation stability. It is a further object of this invention to provide such a composition which can be prepared with a staple commodity of commerce. These and other objects and advantages will become apparent from the disclosure set forth hereinafter.

In accordance with the present invention, the foregoing and other objects and advantages are accomplished with a grease composition comprising a lithium soap derived from a fatty acid containing a functional group and/or ethylenic unsaturation acid and selected from the group consisting of epoxy-substituted fatty acids, monoethylenically unsaturated fatty acids and mixtures thereof and a dilithium soap derived from a straight chain dicarboxylic acid. The grease composition may also contain other constituents, and as pointed out more fully hereinafter, several additional advantages will be realized through the use of one or more additional lithium soaps derived from a hydroxy-substituted carboxylic acid.

DETAILED DESCRIPTION OF THE INVENTION

As previously indicated, the present invention relates to lithium soap grease compositions comprising at least one lithium soap derived from a fatty acid containing a functional group and at least one dilithium soap derived from a straight chain dicarboyxlic acid, which compositions will exhibit a high dropping point, excellent mechanical and/or shear stability, high resistance to water, good oxidation stability and a long lubricating life. As also previously indicated, the lithium soap grease compositions of this invention may comprise a monolithium soap derived from a hydroxy-substituted carboxylic acid.

As used herein, the recitation "derived from" shall mean "obtained by reaction with". Lithium soaps derived from the various fatty and dicarboxylic acids shall, therefore, be lithium soaps obtained by reacting a suitable lithium compound with the acid from which the same is derived.

The grease compositions of this invention can be prepared in accordance with any of the techniques known in the prior art to be useful in the preparation of lithium soap grease compositions. Such methods include, but are not necessarily limited to, those processes wherein the soaps are formed "in-situ" by first dissolving or otherwise incorporating the desired acid or acids in a suitable base oil stock and thereafter neutralizing the same with a suitable lithium compound, and those processes wherein the desired soap or soaps are first separately prepared and thereafter dispersed in or otherwise incorporated into the base oil stock. Such processes also include those processes wherein a portion of one or more soaps or all of one or more, but not all, of the soaps are incorporated into the base oil stock, either by direct addition or in-situ formation, in a first step and the remaining portion or remaining soap or soaps incorporated into the base oil stock, again by either direct addition or in-situ formation, in one or more subsequent steps.

The lubricating oil base stock that is used in preparing the grease compositions of this invention can be any of the conventionally used mineral oils, synthetic hydrocarbon oils or synthetic ester oils. In general, these lubricating oils will have a viscosity in the range of about 35 to 300 SUS at 210° F. Minerals lubricating oil base stocks used in preparing the greases can be any conventionally refined base stocks derived from paraffinic, naphthenic and mixed base crudes. Synthetic lubricating oils that can be used include esters of dibasic acids, such as di-2-ethylhexyl sebacate, esters of glycols such as $C_{13}$ oxo acid diester or tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g. alkylate bottoms from the alkylation of benzene with tetrpropylene, or the copolymers of ethylene and propylene; silicone oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethyl carbonate to form a half ester followed by reaction of the latter with tetraethylene glycol, etc. Other suitable synthetic oils include the polyphenyl ethers, e.g. those having from about 3 to 7 ether linkages and about 4 to 8 phenyl groups. (See U.S. Pat. No. 3,424,686, column 3.)

Broadly, any epoxy-substituted fatty acid and/or any ethylenically unsaturated fatty acid having from about 8 to about 30 carbon atoms could be used in the preparation of the grease compositions of this invention. Best results are, however, obtained when the epoxy-substituted fatty acid and/or the ethylenically unsaturated fatty acid contains from about 12 to about 20 carbon atoms and when the epoxy group and/or the ethylenic unsaturation is separated from the carboxyl carbon atom by from about 7 to about 13 carbon atoms, and, as a result, lithium soaps derived from such acids are preferred.

The expoxy-substituted fatty acids which are useful in the present invention are illustrated generally by the structural formula:

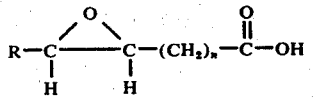

wherein: R may be H or a straight or branched chain hydrocarbon radical containing from 1 to about 27 carbon atoms and n is a whole number ranging from 0 to 27, it being understood that the total number of carbon atoms in both R and $(CH_2)_n$ is from about 5 to about 27, and hence, that when R contains 27 carbon atoms, n must be zero, and when n is 27, R must be H. In the preferred embodiment, n will range from 7 to 13 thus providing a straight chain hydrocarbon radical containing from about 7 to about 13 carbon atoms and R will be either H or a straight or a branched chain hydrocarbon radical containing from about 1 to about 10 carbon atoms. In a most preferred embodiment, n will be 7 and R will be a straight chain hydrocarbon radical containing 8 carbon atoms.

The ethylenically unsaturated fatty acids which are useful in the present invention, on the other hand, are illustrated generally by the structural formula:

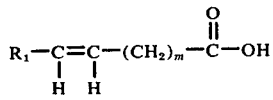

wherein: $R_1$ is independently selected from the same group of radicals as R in the previously described formula and m is a whole number from 0 to 27 in the same manner as n may range from 0 to 27 in the previous formula. Similarly, $R_1$ and m will satisfy all other limitations set forth in the discussion of the previous formula with respect to R and n, respectively, and this is true even with respect to the preferred and most preferred species.

Epoxy-substituted fatty acids which are useful in the present invention include 12,13 epaoxy stearic acid; 15,16 epoxy stearic acid; 9,10 epoxy stearic acid and 9,10 epoxy palmitic acid. Similarly, ethylenically unsaturated fatty acids which are useful in the present invention include oleic acid, linoleic acid, linolenic acid and palmitoleic acid.

The dicarboxylic acid used in the greases of this invention will have from 4 to 12 carbon atoms, preferably 6 to 10 carbon atoms. Such acids include succinic, glutaric, adipic, suberic, pimelic, azelaic, dodecanedioic, and sebacic acids. Sebacic acid and azelaic acid are preferred.

In general, the total lithium soap content of the grease compositions of this invention will range between from about 2 to about 30 wt. %, based on total composition, and this will be the case even when additional lithium soaps, such as a lithium soap derived from a hyroxy-substituted acid, or a plurality of lithium soaps derived from different fatty acids comprising functional groups and/or different dicarboxylic acids, are used. Moreover, the ratio of the total number of moles of lithium soap or soaps derived from one or more epoxy-substituted fatty acids and/or ethylenically-unsaturated fatty acids to the total number of moles of lithium soaps derived from one or more dicarboxylic acids will, generally, range between about 1:1 and about 5:1.

In general, and as has been noted, supra, any method known in the prior art to be effective for the preparation of lithium soap grease compositions can be used to prepare the grease compositions of this invention, and such methods include those wherein an ester or other hydrolyzable form of one or more of the fatty acids and/or the dicarboxylic acids is used in the preparation of the desired and/or corresponding lithium soap. In this regard, it should be noted that such esters and/or other hydrolyzable derivations are readily hydrolyzed to their corresponding acids under the conditions normally employed in the formation of a lithium soap from a free acid. Also, in this regard, it should be noted that when this particular method is employed, the alcohol portion of the ester or that portion of a different hydrolyzable derivative which is separated from the acid during hydrolysis will, ideally, be one which can be easily separated from the grease composition during preparation thereof.

Notwithstanding that any known method could be used to prepare the grease compositions of this invention, good results are consistently obtained, when one or more lithium soaps derived from a fatty acid selected from the group consisting of epoxy-substituted fatty acids, ethylenically-unsaturated fatty acids ad mixtures thereof is used in combination with a single dilithium soap derived from a dicarboxylic acid, simply by dissolving the desired acids or a hydrolyzable derivative thereof in a suitable base oil and thereafter neutralizing the same with a suitable lithium compound such as lithium hydroxide or the like. Generally, the acids and/or hydrolyzable derivatives thereof can be dissolved in the base oil at a temperature between about 150° and 220° F. and the neutralization then accomplished at the same or at a different temperature within the same range. It will, of course, be appreciated that any water formed during the neutralization, as well as any undesirable products resulting from hydrolysis, will generally be separated through flashing at these same temperatures.

While the properties of the grease compositions obtained from the aforedescribed process are, generally, acceptable, certain properties and particularly the dropping point can be further improved by preparing the same with a process such as that disclosed in U.S. Pat. No. 3,791,973 wherein the lithium soaps derived from fatty acids selected from the group consisting of epoxy-substituted fatty acids, ethylenically unsaturated fatty acids and mixtures thereof used in the present invention are treated as the equivalent of the lithium soaps derived from hydroxy-substituted fatty acids in the patents, for process purposes, and to the extent required, the disclosure of this patent is incorporated herein by reference. In accordance with the method of this patent, the improved grease compositions of this invention would be prepared by first forming a mixture comprising a desired base stock and one or more lithium soaps derived from a fatty acid selected from the group consisting of epoxy-substituted fatty acids, ethylenically-unsaturated fatty acids and mixtures thereof, and then adding one or more $C_4$ to $C_{12}$ aliphatic dicarboxylic acids to this mixture and converting the same to the corresponding dilithium soap or soaps under conditions that will ensure the formation of a complex between the lithium soap of the dicarboxylic acid and the lithium soap of the epoxy-substituted and/or ethylenically unsaturated fatty acid. In this regard, it should be noted that there is evidence to indicate that when the dicarboxylic acid is being neutralized with a suitable lithium base in the presence of the other lithium soap or soaps, two competing reactions take place. In one of these reactions either the dicarboxylic acid or its monolithium soap is being incorporated into the crystal lattice of the previously formed lithium soap or soaps, thereby altering their structure. The second competing reaction is the conversion of the dicarboxylic acid to its dilithium soap. Experimental evidence indicates that it is merely necessary to maintain conditions such that the first reaction occurs more rapidly than the second reaction in order to get the desired complex. The principal factors which control the relative rates of reaction include reaction temperature and the rate at which the lithium base is added to bring about the conversion of the dicarboxylic acid to its dilithium soap. Thus in the case of neutralization of the dicarboxylic acid with an aqueous solution of lithium hydroxide, if the reaction is conducted below about 190° F., the complexing reaction will be relatively slow compared with the neutralization reaction and a high dropping point grease will not be obtained, unless the lithium hydroxide is added very slowly. Above about 215° F. the complexing reaction is much more rapid, and it is virtually impossible to add the lithium hydroxide at a sufficiently rapid rate to interfere with the complexing reaction, particularly when the mixture of lubricating oil and the previously prepared lithium soap or soaps have been subjected to a dehydration treatment.

Generally, the grease compositions of this invention comprising one or more lithium soaps derived from a fatty acid selected from the group consisting of epoxy-substituted fatty acids, ethylenically-unsaturated and mixtures thereof and a single dilithium soap will exhibit dropping points within the range from about 450° to about 550° F. It will, of course, be appreciated that a more desirable balance of properties will be achieved when lithium soaps derived from acids within the preferred range thereof are used and, indeed, grease compositions thus prepared will exhibit dropping points within the range from about 500° to about 550° F. It will also be appreciated that further improvement, particularly in dropping points, will be exhibited by those grease compositions prepared in accordance with the methods of U.S. Pat. No. 3,791,973 and, indeed, these compositions, particularly when prepared with lithium soaps within the preferred range, will exhibit dropping points within the upper portion of the aforespecified ranges.

As will be readily apparent from the foregoing, then the basic grease compositions of this invention; i.e. grease compositions comprising one or more lithium soaps derived from a fatty acid having a functional group and selected from the group consisting of epoxy-substituted fatty acids, ethylenically-unsaturated fatty acids and mixtures thereof and a single dilithium soap, could be used in a broad range of multipurpose applications including wheel bearing, roller bearing, and chassis lubrication, as well as certain specialized applications such as the lubrication of oven drier bearings and wheel bearings used with disc brakes. Notwithstanding this broad range of applications, however, it has been found, in accordance with another embodiment of this invention, that various properties of the basic grease compositions such as dropping point and oxidation stability can be further improved through the inclusion of at least one additional lithium soap derived from a hydroxy-substituted carboxylic acid having from 3 to 14 carbon atoms wherein the hydroxyl group is not more than 6 carbon atoms removed from the carboxyl group. In general, this hydroxy substituted acid may be either an aliphatic acid such as lactic acid, hydroxy decanoic acid, 3-hydroxybutanoic acid, 4-hydroxybutanoic acid, 6-hydroxy alpha-hydroxystearic acid, etc. or an aromatic acid such as parahydroxybenzoic acid, salicylic acid, 2-hydroxy-4-hexylbenzoic acid, meta hydroxybenzoic acid, 2,5-dihydroxybenzoic acid (gentisic acid); 2,6-dihydroxybenzoic acid (gamma resorcylic acid); 4-hydroxy-3-methoxybenzoic acid, etc. or a hydroxyaromatic aliphatic acid such as orthohydroxyphenyl, metahydroxyphenyl, or parahydroxyphenyl acetic acid. A cycloaliphatic hydroxy acid such as hydroxy cyclopentyl carboxylic acid or hydroxynaphthenic acid or hydroxynahthenic acid could also be used. An aromatic acid such as salicylic acid is, however, preferred.

Broadly, some improvement will be realized at essentially any concentration of the lithium soap derived from the hydroxy-substituted carboxylic acid and hence, it is within the scope of this invention to employ a wide range of such concentrations consistent with the range of total soap concentrations set forth herein, supra. Best results are, however, obtained when the total soap concentration is within the range of from about 5 to about 20 wt. %, based on total grease composition, and when the weight ratio of lithium soap derived from an epoxy-substituted fatty acid and/or an ethylenically-unsaturated fatty acid to lithium soap derived from dicarboxylic acid is within the range from about 0.5:1 to about 10:1 and when the weight ratio of lithium soap derived from hydroxy-substituted carboxylic acid to lithium soap derived from dicarboxylic acid is within the range from about 0.025:1 to about 2.5:1.

The three component greases of this embodiment may, of course, be prepared with any of the methods heretofore indicated as effective in the preparation of the two-component basic compositions, although certain obvious modifications may occasionally be necessary to facilitate incorporation of the third soap component. One convenient way of preparation, for example, is to first coneutralize the epoxy-substituted and/or the ethylenically unsaturated fatty acid and the dicarboxylic acid in at least a portion of the base oil stock with lithium hydroxide at a temperature in the range of about 180° to 220° F. When the soap stock has thickened to a heavy consistency as the result of this neutralization, the temperature is then raised to about 260° to 300° F. to bring about dehydration. The soap stock is then cooled to about 190° to 210° F. and the hydroxysubstituted acid or a hydrolyzable form thereof added. Additional lithium hydroxide could then be added gradually to convert the acid or hydrolyzable form thereof to the corresponding soap or salt. The second neutralization will, generally, be accomplished at about 220° to 240° F., preferably with agitation so as to facilitate the reaction. Dehydration is then completed at 300° to 320° F. after which the grease is heated at 380°–390° F. for 15 minutes to improve its yield and is then cooled while additional oil is added to obtain the desired consistency. Alternatively, the additional oil can be added to the soap concentrate prior to the in situ formation of the soap or salt from the hydroxy-substituted acid.

Another suitable method of preparation is to coneutralize all three types of acid used in making the grease. Still another method is to co-neutralize the epoxy-substituted and/or ethylenically unsaturated fatty acid and the hydroxy-substituted acid followed by neutralization of the dicarboxylic acid.

PREFERRED EMBODIMENT

In a preferred embodiment of this invention, the grease composition will comprise: a mixture of lithium soaps derived from one or more epoxy-substituted fatty acids and one or more ethylenically-unsaturated fatty acids; and at least one dilithium soap derived from a dicarboxylic acid. In this embodiment, and as indicated, supra, the epoxy group, of the epoxy-substituted acid or acids, and the ethylenic unsaturation, of the ethylenically-unsaturated acid or acids, will be separated from the carboxyl group carbon atom by from about 7 to about 13 carbon atoms and all such acids will contain from about 12 to about 20 carbon atoms. Also in this embodiment, the dicarboyxlic acid or acids will contain from about 6 to about 10 carbon atoms.

In the preferred embodiment, the total lithium soap concentration in the grease compositions will be within the range from about 5 to about 20 wt. %, based on total composition. Moreover, these grease compositions will comprise between about 1 and about 3 mols of lithium soap derived from an epoxy-substituted fatty acid or acids per mol of lithium soap derived from an ethylenically-unsaturated acid or acids, and the mole ratio of total lithium soap derived from epoxy-substituted and ethylenically-unsaturated fatty acids to total dilithium soaps derived from dicarboxylic acids will be within the range from about 1.25:1 to about 2:1. In this regard, it should be noted that while grease compositions comprising soaps derived from epoxy-substituted fatty acids are, generally, superior to those comprising a soap derived from an ethylenically-unsaturated fatty acid, it has surprisingly been discovered that grease compositions comprising a mixture of such soaps within the aforespecified ranges are substantially equivalent to those comprising an equal amount of soap derived from an epoxy-substituted fatty acid. Compositions comprising such mixtures are, therefore, preferred since best results are achieved therewith even though the same are prepared with a significant amount of the cheaper, more readily available unsaturated fatty acids.

In a most preferred embodiment, the grease compositions will comprise a mixture of monolithium soaps derived from 9,10 epoxy stearic acid and oleic acid and a dilithium soap derived from azelaic acid. In this most preferred embodiment, the monolithium soaps will be present in a mol ratio of about 1:1 and the mol ratio of monolithium soaps to dilithium soaps will be about 1.5:1.

Having thus broadly and specifically described the present invention, it is believed that the same will become even more apparent by reference to the following examples which are included for purposes of illustrating particularly preferred embodiments and which are in no way intended to limit the scope of said invention.

EXAMPLE 1

For purposes of comparison and in this example, 10 g (0.032 moles) of methyl 9,10-epoxy stearate were combined with 58 g. of a solvent refined and hydro-finished naphthenic, base oil, distillate (LCT-20 base) having a viscosity of 315 SUS at 100° F. and a VI of 67 and heated to 200° F. After the ester had dissolved and at this temperature, 10 ml of a hot aqueous solution comprising 1.47 g of lithium hydroxide monohydrate were added and the mixture held at this temperature with stirring for 5 min. The mixture was then heated to 350° F. to insure complete dehydration of the resulting grease. A sample of the resulting grease composition was tested for dropping point and penetration. The results obtained from these tests are summarized in the Table following Example 11.

EXAMPLE 2

Also for purposes of comparison, the procedure of Example 1 was repeated except that 10 grams (0.035 mols) of oleic acid were substituted for the methyl epoxy stearate used in that Example and then was dissolved in 40 g. of base oil, rather than 58 g. and 1.72 g.

of lithium hydroxide was used for neutralization. Again, the grease obtained was tested for dropping point and penetration and the results of these tests are summarized in the Table following Example 11.

EXAMPLE 3

Also for purposes of this invention, the procedure of Example 1 was again repeated except that 6.7 grams (0.021 mols) of methyl 9,10-epoxy stearate and 6.7 rams (0.024 mols) of oleic acid were combined and substituted for the epoxy stearate used in that Example. Also, a hot solution comprising 2.08 g. of lithium hydroxide monohydrate (rather than 1.47 g) was used and the ester and acid were dissolved in only 40 g. of base oil rather than 58 g. Finally, the grease was dehydrated at 380° F. rather than 350° F. Again, the grease obtained was tested for dropping point and penetration and the results obtained are summarized in the Table following Example 11.

EXAMPLE 4

In this Example, a grease composition was prepared in accordance with a most preferred method of this invention by charging 100 grams of methyl 9,10 -epoxy stearate (0.32 mols) and 200 grams of base oil identified as LCT-20 base, which was a solvent refined and hydrofinished naphthenic distillate having a viscosity of 315 SUS at 100° F. and a V.I. of 67 to a grease kettle. The contents of the kettle were heated to 200°–205° F. with stirring. After 20 minutes the acid was completely dissolved in the base oil. Then over a period of 15 minutes there was added to the stirred mixture a concentrated solution of 14.7 grams (0.35 mol) of lithium hydroxide monohydrate in 160 milliliters of water. This amount of lithium hydroxide was in excess of the amount theoretically required to neutralize the acids and was sufficient to give the finished grease a free alkali content of 0.1 to 0.2% by weight. After the addition of the lithium hydroxide, the temperature of the mixture was raised over a period of about 30 minutes to 300° F., where it was held for one hour to ensure the elimination of water. Then the temperature was lowered to 200° F. Azelaic acid (34.7 g. – 0.185 mol) was added. A hot aqueous solution of lithium hydroxide monohydrate (15.3 g. – 0.364 mol) in 160 ml of water was added slowly over 15 minutes. The temperature was then raised to 300° F. and held there for 1 hour. The temperature was then further raised to 390° F. for 30 minutes. At this time, additional LCT 20 base oil (200 gm) was added over 1 hour. Then the grease was milled in a Charlotte mill and cooled to room temperature. Again, the dropping point and penetration of the grease were determined and the results are summarized in the Table.

EXAMPLE 5

In this example, the procedure of Example 2 was repeated except that 100 g oleic acid (0.355 mol) were combined with about 38 g (0.2 mols) azelaic acid and substituted for the oleic acid of that Example. The mixed acid was then dissolved in a larger quantity of oil and neutralized with a hot solution containing 56.1 g. lithium hydroxide monohydrate. Following dehydration and cooling the grease obtained in this Example was tested for dropping point and penetration and the results are summarized in the Table following Example 11.

EXAMPLE 6

In this Example, the one-step neutralization procedure of Examples 1–3and 5 was repeated. In this Example, however, 67 g. (0.238 mols) of oleic acid, 67 g. (0.215 mols) methyl 9,10 epoxy stearate and 30 g. (0.215 mols) adipic acid were first dissolved in 200 g. of an LCT-20 base stock and then neutralized at 200° F. with a hot aqueous solution containing 38.2 g. lithium hydroxide monohydrate. This mixture was then heated so as to remove water. Following the dehydration, 300 g. addition LCT-20 base oil stock was added and the grease cooled. The dropping point and penetration of the grease obtained in this Example is summarized in the Table following Example 11.

EXAMPLE 7

In this Example, 100 g. (0.321 mols) methyl 9,10-epoxy stearate and 34.7 g. (0.185 mols) azelaic acid were dissolved in 200 g. LCT-20 base at 200° F. 200 ml. of a hot aqueous solution of lithium hydroxide monohydrate containing 30.2 g. lithium hydroxide monohydrate was then added slowly over about a 30-minute period. The resulting composition then heated to 300°F. for one hour, cooled to 200° F. and 30 g. (0.197 mols) methyl salicylate added. Following this addition, a sufficient quantity of hot aqueous solution was added to provide 15.5 g. lithium hydroxide monohydrate for purposes of neutralizing the salicylate. Following this neutralization step, the grease composition was again heated to 300° F. (ca. for one hour) and then 390° F. (ca. 30 min.) for purposes of dehydration. Following the dehydration, an additional 200 g. LCT-20 base oil stock was added and the grease cooled. The dropping point and penetration of the grease of this Example were determined and they are summarized in the Table after Example 11.

EXAMPLE 8

The preparation set forth in Example 7 was repeated except that 100 g. oleic acid and 34.7 g. adipic acid were substituted for the three component mixture and used in the first step. The composition and properties of the grease thus obtained are summarized in the Table following Example 11.

EXAMPLE 9

In this Example a grease was prepared in accordance with the procedure set forth in Example 7 except that 67 g. oleic acid, 74 g. methyl 9,10-epoxystearate and 30 g. azelaic acid were used in the first step of the grease preparation. Again, the composition and certain properties of the grease thus obtained are summarized in the Table following Example 11.

EXAMPLE 10

For purposes of further comparison a grease was prepared with the method described in Example 4, except that 76.2 g. 12-hydroxystearic acid were substituted for the 100 g. methyl 9,10-epoxystearate and neutralized with 10.8 g. $LiOH.H_2O$ (rather than 14.7 g.) and only 26.5 g. azelaic acid were used in a second neutralization step and this was neutralized with 11.9 g. $LIOH.H_2O$ (rather than 15.3 g.). The exact composition and certain properties of the grease obtained are summarized in the Table following Example 11 for purposes of convenient comparison.

EXAMPLE 11

For purposes of still further comparison a grease was prepared with the procedure set forth in Example 7, except that 76.2 g. 12-hydroxystearic acid were substituted for the epoxystearate and only 26.5 g. azelaic acid were used in the first step and only 22.8 g. LiOH.-$H_2O$ were used in the first neutralization step. To facilitate convenient comparison, the composition and certain properties of the grease thus prepared are summarized in the Table below.

TABLE

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| Grease Formulation, wt. % | | | | | | | | | | | |
| 12-Hydroxy-stearic Acid | — | — | — | — | — | — | — | — | — | 14.50 | 11.34 |
| Oleic Acid | — | 19.33 | 12.08 | — | 17.65 | 9.54 | — | 16.19 | 8.91 | — | — |
| Methyl 9,10-Epoxystearate | 14.39 | — | 12.08 | 17.71 | — | 9.54 | 16.38 | — | 9.84 | — | — |
| Azelaic Acid | — | — | — | 6.14 | 6.13 | — | 5.68 | — | 3.99 | 5.04 | 3.94 |
| Adipic Acid | — | — | — | — | — | 4.27 | — | 5.62 | — | — | — |
| Methyl Salicylate | — | — | — | — | — | — | 4.91 | 4.86 | 3.99 | — | 4.46 |
| LiOH | 2.12 | 3.33 | 3.75 | 5.31 | 5.61 | 5.44 | 7.49 | 8.55 | 6.75 | 4.32 | 5.84 |
| LCT-20 Base | 83.49 | 77.34 | 72.09 | 70.84 | 70.61 | 71.21 | 65.54 | 64.78 | 66.52 | 76.14 | 74.42 |
| D.Pt., ° F. | 380 | 372 | 382 | 500 | 559 | 547 | 600+ | 600+ | 600+ | 525 | 585 |
| Penetration, mm/10 at 77° F. | 301 | 191 | 178 | 182 | 228 | 254 | 252 | 206 | 284 | 174 | 240 |

From the results summarized in the Table, it will be readily apparent that the basic composition greases of this invention exhibit excellent grease properties. As will also be readily apparent, the grease properties are generally improved when the greases comprise a hydroxy-substituted aromatic acid,, Examples 7, 8 and 9.

While the present invention has been described by reference to particularly preferred embodiments thereof, it will be appreciated that the same lends itself to variations and modifications which would be obvious to those skilled in the art. For this reason, then, reference should be made solely to the appended claims to determine the scope of the present invention.

Having thus described and illustrated the present invention:

1. A grease composition comprising a lubricating base oil stock, a lithium soap derived from an epoxy-substituted fatty acid, characterized by the structural formula:

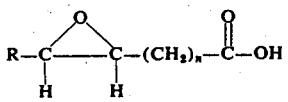

wherein:

R may be H or a straight or branched chain hydrocarbon radical containing from 1 to about 27 carbon atoms and n is a whole number ranging from 0 to 27, with the proviso that the total number of carbon atoms in both R and $(CH_2)_n$ is from about 5 to about 27; and a dilithium soap derived from an aliphatic dicarboxylic acid having from about 4 to about 12 carbon atoms therein, the mole ratio of lithium soap derived from a fatty acid to dilithium soap being between about 1:1 to about 5:1.

2. The grease composition of claim 1 wherein n is a whole number from about 7 to about 13.

3. A grease composition comprising a lubricating base oil stock, at least one lithium soap derived from a fatty acid containing a functional group and selected from the group consisting of epoxy-substituted fatty acids, characterized by the structural formula:

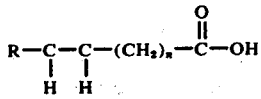

wherein:

R may be H or a straight or branched chain hydrocarbon radical containing from 1 to about 27 carbon atoms and n is a whole number ranging from 0 to 27, with the proviso that the total number of carbon atoms in both R and $(CH_2)_n$ is from about 5 to about 27; ethylenically-unsaturated fatty acids characterized by the structural formula:

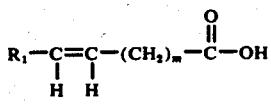

wherein:

$R_1$ is independently selected from the same group of radicals as R, m is a whole number from 0 to 27 and $R_1$ and $(CH_2)_m$ satisfy all limitations set forth with respect to R and $(CH_2)_m$;

and mixtures thereof, and at least one dilithium soap derived from an aliphatic dicarboxylic acid having from about 4 to about 12 carbon atoms therein, and at least one lithium soap derived from a hydroxy-substituted carboxylic acid having from 3 to 14 carbon atoms therein and the hydroxy groups separated from the carboxyl group from about 1 to about 6 carbon atoms, the mole ratio of lithium soap derived from a fatty acid to dilithium soap being between about 1:1 to about 5:1 and the weight ratio of lithium soap derived from a hydroxy-substituted carboxyl acid to dilithium soap being within the range from about 0.025:1 to about 2.5:1.

4. The grease composition of claim 3 wherein said fatty acid is an epoxy-substituted fatty acid.

5. The grease composition of claim 4 wherein n is a number from about 7 to about 13.

6. The grease composition of claim 3 wherein said fatty acid is an ethylenically unsaturated fatty acid.

7. The grease composition of claim 6 wherein m is a whole number from about 7 to about 13.

8. The grease composition of claim 3 wherein said fatty acid is a mixture comprising an epoxy-substituted fatty acid and an ethylenically unsaturated fatty acid.

9. The composition of claim 8 wherein both n and m are a whole number from about 7 to about 13 and wherein the grease composition comprises between about 1 and about 3 moles of lithium soap derived from a epoxy substituted fatty acid per mole of lithium soap derived from an ethylenically unsaturated acid.

10. The composition of claim 8 wherein the molar ratio of epoxy-substituted fatty acid to ethylenically unsaturated fatty acid is within the range of from about 1:1 to about 3:1.

11. The composition of claim 2 wherein said epoxy-substituted fatty acid is 9, 10 epoxy stearic acid and wherein said dicarboxylic acid is azelaic acid.

12. The composition of claim 5 wherein said epoxy-substituted fatty acid is 9,10 epoxy stearic acid and wherein said dicarboxylic acid is azelaic acid.

13. The composition of claim 7 wherein said ethylenically unsaturated fatty acid is oleic acid and said dicarboxylic acid is azelaic acid.

14. The composition of claim 9 wherein said epoxy-substituted fatty acid is 9,10 epoxy stearic acid, said ethylenically unsaturated fatty acid is oleic acid and said dicarboxylic acid is azelaic acid.

15. The composition of claim 12 wherein said hydroxy-substituted carboxylic acid is salicylic acid.

16. The composition of claim 13 wherein said hydroxy-substituted carboxylic acid is salicylic acid.

17. The composition of claim 14 wherein said hydroxy-substituted carboxylic acid is salicylic acid.

* * * * *